US007361034B1

(12) United States Patent
Chiu et al.

(10) Patent No.: US 7,361,034 B1
(45) Date of Patent: Apr. 22, 2008

(54) PORTABLE STORAGE DEVICE

(75) Inventors: Kun-Chin Chiu, Taipei (TW); Chih-Yung Chi, Taipei (TW); Chih-Hsin Wu, Taipei (TW)

(73) Assignee: Asustek Computer, Inc., Peitou, Taipei (TW)

( * ) Notice: Subject to any disclaimer, the term of this patent is extended or adjusted under 35 U.S.C. 154(b) by 0 days.

(21) Appl. No.: 11/849,664

(22) Filed: Sep. 4, 2007

(30) Foreign Application Priority Data

Oct. 19, 2006 (TW) ..... 95138612 A

(51) Int. Cl.
*H01R 13/44* (2006.01)

(52) U.S. Cl. ..... 439/131; 439/135

(58) Field of Classification Search ..... 439/131, 439/135, 134

See application file for complete search history.

(56) References Cited

U.S. PATENT DOCUMENTS

| | | | | |
|---|---|---|---|---|
| 6,676,420 | B1 | 1/2004 | Liu et al. | |
| 6,808,400 | B2 | 10/2004 | Tu | |
| 7,009,847 | B1 | 3/2006 | Wu et al. | |
| 7,104,814 | B1 * | 9/2006 | She et al. | 439/131 |
| 2003/0103369 | A1 * | 6/2003 | Wu | 365/131 |

* cited by examiner

*Primary Examiner*—Tho D Ta
(74) *Attorney, Agent, or Firm*—Thomas, Kayden, Horstemeyer & Risley

(57) ABSTRACT

A portable storage device structure is described. A memory device has a connector and a first concave portion. An opening defined on a hollow housing to form two sections of the hollow housing with different lengths. The longer section has a second concave portion. A resilient member has one end secured to the second concave portion to suspend the opposite end. When the memory device assembles to the hollow housing, the opposite end of the resilient member engages with the first concave portion to avoid the memory device from slipping out of the housing.

14 Claims, 3 Drawing Sheets

PORTABLE STORAGE DEVICE

RELATED APPLICATIONS

This application claims priority to Taiwan Application Serial Number 95138612, filed Oct. 19, 2006, which is herein incorporated by reference.

BACKGROUND OF THE INVENTION

1. Field of the Invention

The invention relate to a storage device and, more particularly, to a portable storage device.

2. Description of the Related Art

With the quickly development of the flash memory manufacture technology, the high-capacity flash memories have been widely applied in the storage device. Particularly, the portable storage device or USB disk in the market are using the high-capacity flash memory to reduce the volume of the storage device to the size of thumb.

The most common interface of the portable storage device is universal serial bus (USB). The housing of the portable storage device always includes a cover to cover the USB connector for dust proofing when the portable storage device is not in use.

However, when the portable storage device is in use, for example the USB connector is inserted into the connector of the computer, the cover is always placed near the computer. The cover of the portable storage device may easily to be lost since its small size, and then the USB connector also loses its dust-proof function.

BRIEF SUMMARY OF THE INVENTION

The objective of the invention is to provide a portable storage device for the convenience of users to carry and use.

According to the above objective, the invention provides a portable storage device. The structure of the portable storage device includes a memory device, a hollow housing, and a resilient member. The memory device includes a connector and a body. The connector is disposed on one end of the memory device, and the body has a first concave portion. A first opening is defined on the hollow housing and the body can be pushed into the hollow housing through the first opening. The resilient member is fixed at the inner surface of the hollow housing. When the connector passed through the first opening to push the body and the connector into the hollow housing, the resilient member is wedged into the first concave portion. When the body has been pushed in to the hollow housing and the connector is exposed out of the hollow housing, the resilient member is also wedged into the first concave portion to avoid the memory device separate from the hollow housing.

The hollow housing further includes a second opening to expose a part of the body which has been pushed into the hollow housing. When the body has been exerted a pressure through the second opening, the resilient member separates from the first concave portion.

The connector can be a USB connector and the memory device further includes a memory chip. When the memory device assembles with the hollow housing, the connector can be disposed inside or outside of the first opening. The portable storage device further includes a hanging belt connecting to the hollow housing for the convenience of users to carry.

BRIEF DESCRIPTION OF THE DRAWINGS

These and other features, aspects, and advantages of the present invention will become better understood with regard to the following description, appended claims, and accompanying drawings.

DETAILED DESCRIPTION IF THE EMBODIMENTS

As mentioned above, the invention provides a portable storage device for the convenience of users to carry and store, and also to provide dust-proof function for a connector.

Figure 1:
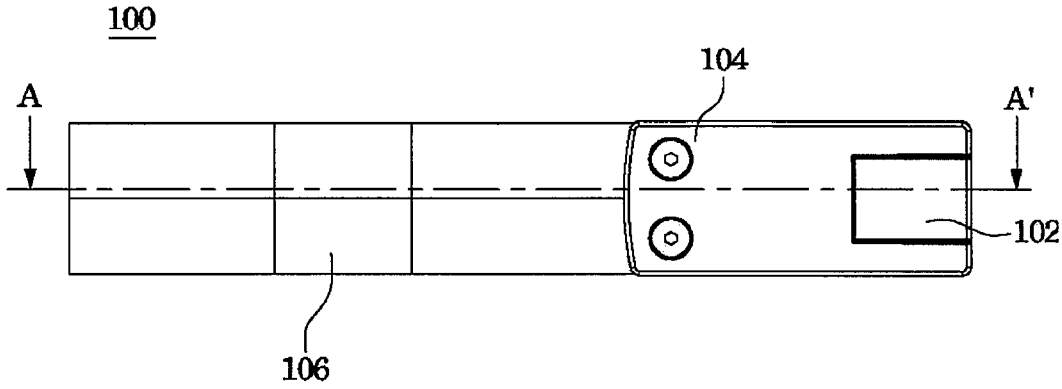
FIG. 1 is a vertical schematic diagram showing a portable storage device of an embodiment of the invention.
Figure 2:
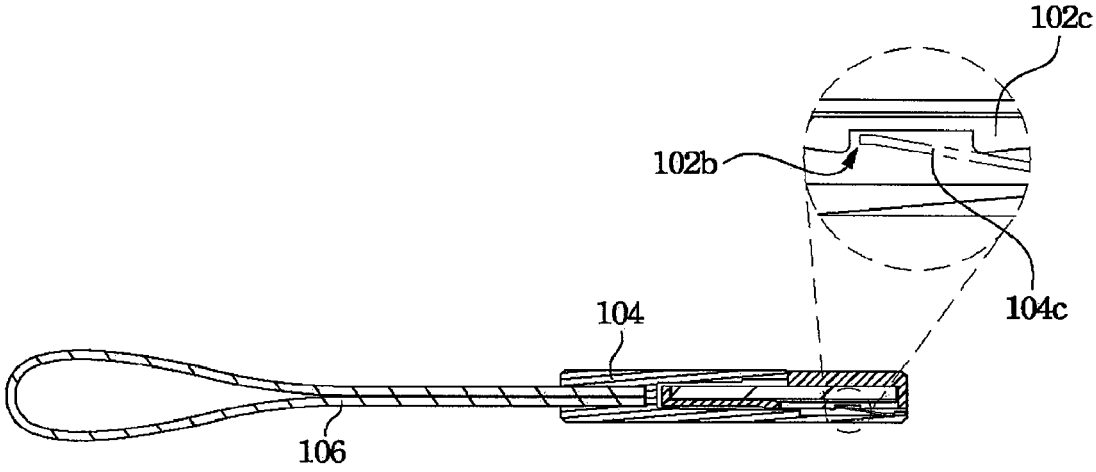
FIG. 2 is a cross-sectional schematic diagram showing the portable storage device of FIG. 1 along the hatches A-A'.

Please refer to FIGS. 1 and 2. FIG. 1 shows a portable storage device 100 and FIG. 2 is a cross-sectional schematic diagram showing the portable storage device 100 of FIG. 1 along the hatches A-A'. The portable storage device 100 includes the combination of a hollow housing 104 and a memory device 102. The portable storage device 100 further includes a hanging belt 106 for convenience of users to carry and store.

Figure 4:
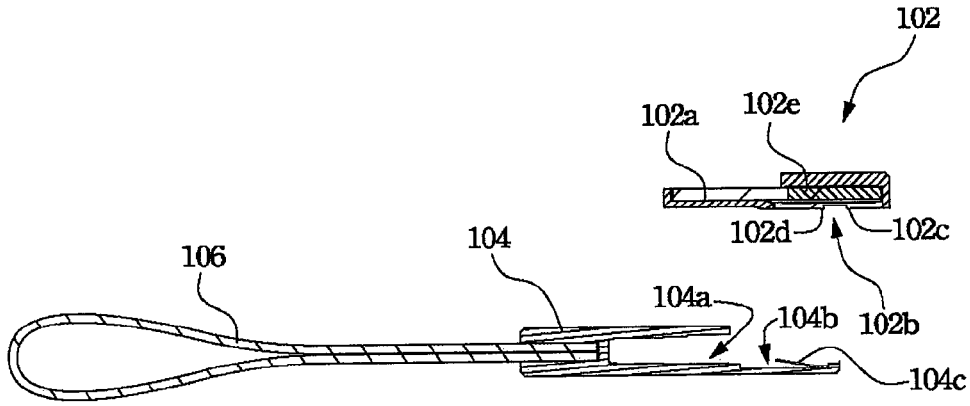
FIG. 4 is a cross-sectional exploded schematic diagram showing a portable storage device of an embodiment of the invention.

Please refer to FIG. 4, which is the cross-sectional exploded schematic diagram showing a portable storage device according to an embodiment of the invention. The memory device 102 has a connector 102*a* and body 102*e*. The connector 102*a* is disposed at one end of the memory device and the body 102*e* has a first concave portion 102*b*. The connector 102*a*, such as a USB connector, is for inserting into a corresponding connector slot, such as a connector slot of a computer, to make the body 102*e* can be read or stored information. The memory chip included in the body 102*e* can be a non-volatile memory, such as a flash memory. The first concave portion 102*b* is around with raises 102*c*/102*d*. A first opening 104*a* is defined on the hollow housing 104. The hollow housing has two sections with different lengths of each side of the first opening 104*a*, and the longer section has a second concave portion 104*b*. The measure of area of the second concave portion 104*b* is greater than the first concave portion 102*b*. The resilient member 104*c* has one end secured in the second concave portion 104*b* (at the bottom of the second concave portion 104*b*) and the other end suspended to protrude the second concave portion 104*b*. The memory device 102 and the hollow housing 104 can be assembled or separated according to use states.

Please refer to FIG. 2. When the memory device 102 is not in use, for example the body 102*e* is not in reading or storing information, the connector 102 is positioned in the first opening 104*a*. The suspended end of the resilient member 104*c* is wedged into the first concave portion 102*b* to avoid the memory device 102 separate from the hollow housing 104. Users also can carry the portable storage device conveniently by the hanging belt 106.

Figure 3:
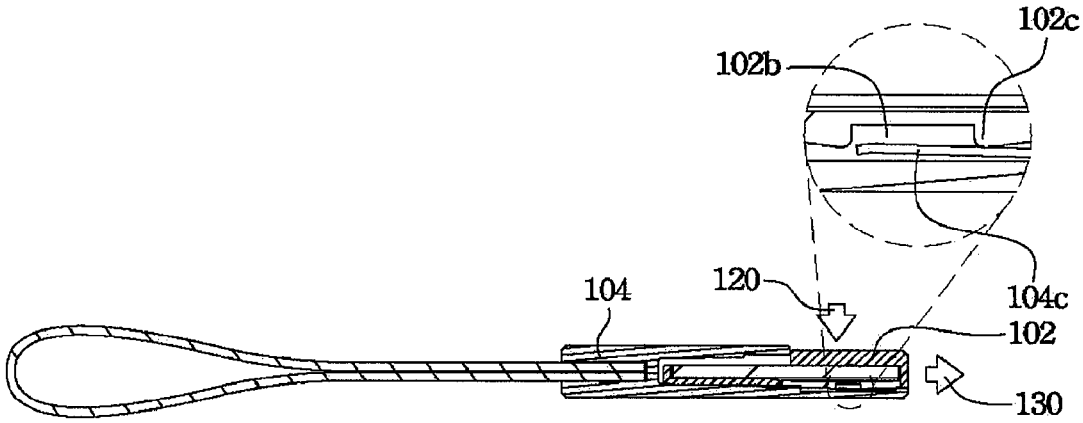
FIG. 3 shows the method of the memory device departs from the hollow housing of the portable storage device of the invention.

Please refer to FIG. 3, when the memory device 102 wants to separate from the hollow housing 104, user can press along a direction 120, and then the raise 102*c* presses the resilient member 104*c* and separate it from the first concave portion 102*b*. After that, the memory device 102 can be pulled out of the hollow housing 104 along a direction 130. The connector 102*a* of the memory device 102 can be inserted into a corresponding connector slot. Please note, the raises 102*c*/102*d* around the first concave portion 102*b* are not necessary, but they can help the resilient member 104*c* separated from the first concave portion 102*b* easily.

Figure 5:
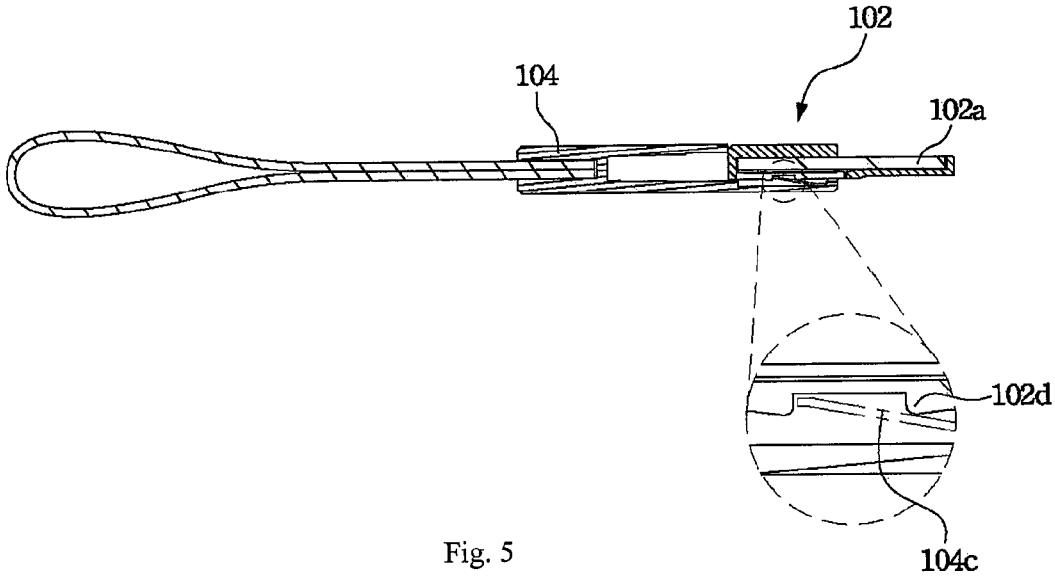
FIG. 5 is a cross-sectional schematic diagram showing a portable storage device in using state of an embodiment of the invention.

Please refer to FIG. 5, when the connector 102*a* of the memory device 102 inserts a corresponding connector slot, the memory device 102 and the hollow housing 104 can be assembled in another way. The difference between this assembling method and the assembling method of FIG. 2 is that the connector 102*a* of the memory device 102 locates out of the opening 104*a* but the suspended end of the resilient member 104*c* still can be wedged into the first concave portion 102*b* to avoid the memory device 102 separated from the hollow housing 104. When the memory device 102 needs to be separated from the hollow housing 104, the memory device 102 is pulled out from the hollow housing 104 by the same way of FIG. 3. The advantages of the assembling method of FIG. 5 is the memory device 102 can combine with the hollow housing 104 at any time and to prevent loss of storage body memory device 102 with small volume.

Figure 6:
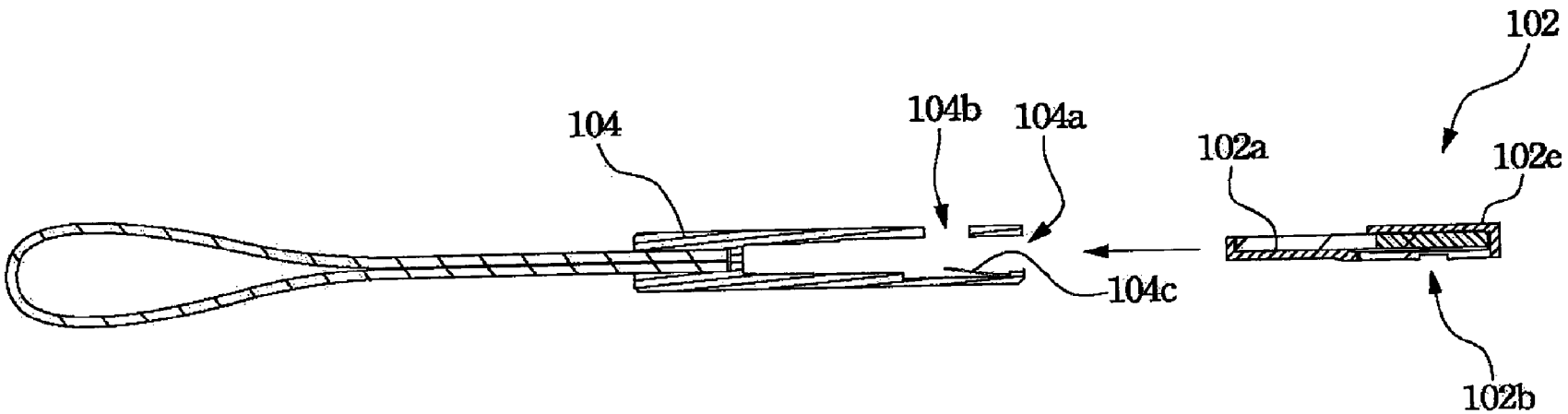
FIG. 6 is a cross-sectional exploded schematic diagram showing a portable storage device of another embodiment of the invention.

Please refer to FIG. 6, it shows a cross-sectional exploded view of a portable storage device according to another embodiment of the invention. Compare with the embodiment of FIG. 4, the hollow housing 104 of FIG. 6 has two sections with same length at each side of the first opening 104*a* and a second opening 104*d* is defined on the hollow housing 104. The connector 102*a* of the memory device 102 can be pushed into the hollow housing 104 through the first opening 104*a*. A part of body 102*e* is exposed from the second opening 104*d* (when the memory device in the hollow housing 104), to receive a pressure through the second opening 104*d* for separating the resilient member 104*c* from the first concave portion 102*b*.

According to the above embodiments, applying the portable storage device of the invention, users can carry it conveniently by the hanging belt, and providing a dust-proof function to connector and avoiding loss of the memory device by the hollow housing.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A portable storage device, comprising:

a memory device having a connector and a body, the connector being disposed at one end of the memory device and the body having a first concave portion;

a hollow housing having a first opening, the body being pushed into the hollow housing through the first opening; and a resilient member fixed at the inner surface of the hollow housing, wherein when the connector passes through the first opening and the body and the connector are pushed into the hollow housing, the resilient member wedges into the first concave portion, when the body is pushed into the hollow housing with the connector being left outside of the hollow housing, the resilient member also wedges into the first concave portion for avoiding the memory device separating from the hollow housing.

2. The portable storage device according to claim 1, wherein the hollow housing further includes a second opening to expose a part of the body which been pushed into the hollow housing, and when the body has been exerted a pressure through the second opening, the resilient member separates from the first concave portion.

3. The portable storage device according to claim 1, wherein the first concave portion is around with raises.

4. The portable storage device according to claim 1, when the memory device having been assembled with the hollow housing, the connector being in the first opening.

5. The portable storage device according to claim 1, when the memory device having been assembled with the hollow housing, the connector being out of the first opening.

6. The portable storage device according to claim 1, further comprising a hanging belt to connect with the hollow housing.

7. The portable storage device according to claim 1, wherein the connector is a universal serial bus connector.

8. The portable storage device according to claim 1, wherein the inner surface of the hollow housing has a second concave portion, one end of the resilient member is fixed in the second concave portion and another end is suspended above the second concave portion.

9. The portable storage device according to claim 8, wherein one end of the resilient member is fixed at bottom of the second concave portion and another end protrudes out of the second concave portion.

10. The portable storage device according to claim 8, wherein the measure of area of the second concave portion is greater than the measure of area of the first concave portion.

11. The portable storage device according to claim 10, wherein two sections of the hollow housing defined by the first opening are in different length and the second concave portion is disposed at the longer section.

12. The portable storage device according to claim 1, wherein the memory device includes a memory chip.

13. The portable storage device according to claim 12, wherein the memory chip is a non-volatile memory.

14. The portable storage device according to claim 13, wherein the non-volatile memory is flash memory.

* * * * *